United States Patent [19]

Reilly et al.

[11] 4,395,265

[45] Jul. 26, 1983

[54] FUEL PELLETS

[76] Inventors: Charles Reilly, 777 E. 31st St., Brooklyn, N.Y. 11210; Richard G. Bailey, 4308 W. 82 St., Prairie Village, Kans. 66208

[21] Appl. No.: 331,044

[22] Filed: Dec. 16, 1981

[51] Int. Cl.[3] ..... C10L 5/14; C10F 7/06

[52] U.S. Cl. ..... 44/15 R; 44/1 D; 44/10 A; 44/32

[58] Field of Search ..... 44/1 D, 10 A, 15 R, 44/15 D, 31, 32

[56] References Cited

U.S. PATENT DOCUMENTS

| | | | |
|---|---|---|---|
| 43,695 | 8/1865 | Lucas | 44/32 |
| 1,000,479 | 8/1911 | Zindler | 44/32 |
| 4,015,951 | 4/1977 | Gunnerman | 44/10 E |
| 4,236,897 | 12/1980 | Johnston | 44/10 A |

FOREIGN PATENT DOCUMENTS

| | | | |
|---|---|---|---|
| 154289 | 11/1920 | United Kingdom | 44/32 |

*Primary Examiner*—Carl F. Dees

*Attorney, Agent, or Firm*—Howard I. Podell

[57] ABSTRACT

Pellet material and a process for producing such pellet material, which pellet material is suitable for use as an improved fuel that is particularly suitable for use in automatic stoker furnaces and kilns, and for home heating. The pellets are formed of a mixture of particulate peat and coal fines, with the peat serving both as a binder to retain the shape of the pellets and as a fuel material. The process of forming the pellets consists of air drying and then milling or grinding peat, mixing this particulate matter with coal fines or ground sludge material, and then pelletizing the resulting mixture in a pelletizer such as a pellet mill, with the pellets then air-dried to reduce the moisture content to a range of about 10% to 15% by weight.

10 Claims, 2 Drawing Figures

FUEL PELLETS

BACKGROUND OF THE INVENTION

This invention applies to a pellet fuel material and a process for producing such material in the form of pellets from peat and coal fines and sludge residues.

DESCRIPTION OF CURRENT ART

The use of peat, coal fines, or sludge residues from sewage plants have been considered as energy sources of fuel. However, such materials in their conventional forms do not lend themselves to automatic stoker equipment and to conventional combustion equipment as a satisfactory industrial fuel nor as a home heating fuel. Coal fines are a waste product and peat material does furnish sufficient energy in conventional forms for use as a satisfactory industrial fuel. Pellet mills are conventionally employed to produce durable pellets.

U.S. Pat. Nos. 3,525,685; 3,772,118 describe prior art processes for treatment of sewage to produce sludge.

The following disclosures are made of references that may be relevent to the examination of this application but such disclosures do not constitute any admission that the references describe prior art with relation to the applicant's invention.

A sludge treatment plant is described in "Sludge", Feb. 18, 1981, page 27, and also described in News Release of Mar. 2, 1981 of the International Waste Water Reclamation Technologies, Inc., pages 1–3. A printed circular, undated, of the Simon-Barron Company describes the Paladin pellet mill and its use for processing of peat, bio-mass or waste-derived fuels. A proposal for a pellet process for pelletizing sewage residue in an effort to turn it into fuel is described in "Sludge", Apr. 15, 1981, page 63, which latter article quotes the applicant on the feasibility of pulverizing such pellets for blowing a powdered suspension of the sewage residue into a furnace.

Peat in either the reed-sedge grade or the peat sphagnum moss grade or the humus grade is described in Federal specification Q-P-166e of May 10, 1961. Coal blending procedures to average out pollutants is described in "Power Engineering" of June, 1981 on pp. 86–88.

While existing expedients are generally acceptable for their intended purposes only, they have not proven entirely satisfactory in that they are either complex and expensive to manufacture, or bulky and inconvenient to use, or require unusual dexterity to operate. As a result of these shortcomings, there has developed a substantial need for improvement in this field.

The principal object of this invention is to provide an economical fuel material may by a process which combines simplicity, reliability and effectiveness in a high degree. The recited inexpensive process to produce such fuel should encourage widespread use thereof, and assist in the reduction of the current energy shortage.

Other objects of this invention will in part be obvious and in part hereinafter pointed out.

The invention accordingly consists in the features of construction, combinations of elements, and arrangement of process steps which will be exemplified in the construction hereinafter described, and of which the scope of application will be indicated in the following claims.

SUMMARY OF THE INVENTION

This invention resides in pellet material, and a process for producing such pellet material, which pellet material is suitable for use as an improved fuel and particularly suitable for use in automatic stoker furnaces and kilns, as well as home heating units equipped with grates. The pellets consist of a mixture of peat such as sphagnum moss humus or reed and sedges grade, and powdered coal such as coal fines. The peat serves both as a binder to retain the shape of the pellets and as a fuel material itself. The process of forming the pellets consists of air drying and grinding of peat from its normal form which can average up to 70% moisture, to bring it down to about 50% moisture or less, mixing the peat with coal fines which brings the moisture content of the mixture to approximately 25 to 30% maximum. Due to the high compression of the pelleting die and as a result of the heat generated in pelletizing, the pellets lose 2–3% moisture in the pelletizing operation.

The resulting mixture is pelletized in a pelletizer such as a pellet mill and the pellets then air dried to reduce moisture content to a range of 10%–15% or less. Other fuel material such as ground-up sludge or croal may be substituted for coal fines.

In the invention, pellets of an energy value of 9,000–11,000 BTU per pound are produced which may be directly burned on grates, fed by automatic stokers, and if desired, pulverized and blown into a furnace in suspension.

It is well known that coal fines do not pelletize or briquette without using expensive binders such as starch. This makes the end product very expensive.

Peat contains natural waxes and resins which when mixed with the coal fines and then put through a pelletizer under compression bind the whole product together into a solid hard pellet which does not lose its shape when being stored or burned on grates in a stove.

In the preferred embodiment of the invention, the pellets of the invention are mixtures of peat and coal fines. Pellets can be also formed of mixtures of peat and sludge residue material provided that the moisture content of the mix is less than 35% prior to pelletizing.

The peat serves a dual function. The peat acts as a means of binding the mixture together so that after being compressed in a pellet mill, the pellets will remain firm and resist further powdering during conditions of storage transport, and burning. Peat contains resins and waxes which, under compression in the pelletizing process, are released to serve as binders of the coal fines and peat. The resin and wax binders result in a solid pellet that withstands abrasion in handling and storage and serves to maintain the pellet shape, after drying, and during combustion. These binder materials age harden after the pelletizing and drying step of my process.

As a second advantage, the peat itself contributes to the fuel energy content of the finished pellet, and the mixture of peat and coal fines burns more readily than either compressed peat or solid coal. The ideal mix of the peat and coal fines should be about 50/50. But it is possible to raise the percentage of coal to around 70% and decrease the peat to around 30% and thus increase the BTU content of the pellet.

A third advantage of our invention is that the resulting mixtures of coal and peat, in the pellets of the invention, have a lower sulfur content than that of the coal itself so as to permit use of coal fines that would otherwise be prohibited by local ordinances because of excessive sulfur content. Tests of pellets made in my process show that the final pellets of my invention have a sulfur content of 0.62% or 0.36% when formed with coal fines of bituminous (soft) or anthracite (hard) coal respectively, where the original coal before mixture had a sulfur content of 1.5% for the bituminous coal fines and 0.5% for the anthracite coal fines respectively.

A further advantage of our invention lies in the pelletizing of mixtures of coal fines of different sulfur or other pollutant contents to form pellets that are a blend of peat and coal in which the total pollutant content of each pellet is within the acceptable limits for the respective pollutants. At present coal of various grades of heat content and pollutant content are mixed together to form acceptable fuel mixtures, but such mixtures of the respective coal fines in usable pellets are too expensive using conventional processes of pelletizing coal fines, because of the expense of conventional binder material.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENT

Figure 1:
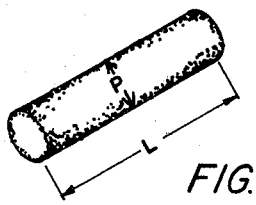
FIG. 1 is a perspective view of the pellet produced by the process.
Figure 2:
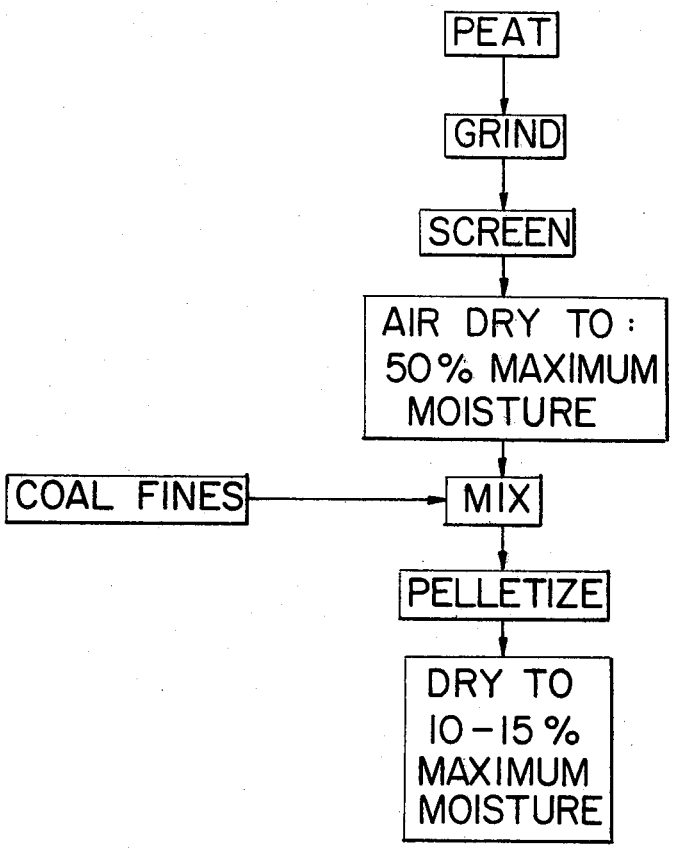
FIG. 2 is a schematic drawing of the process.

With reference to the drawing, there is shown and illustrated, FIG. 1 illustrates a pellet 10 formed by the process of FIG. 2. The pellet is preferably of a length L ranging from three-quarters inch to two inches and of a diameter ranging preferably from $\frac{3}{8}$ inch to $\frac{3}{4}$ inch as produced from a conventional pellet mill, such as a Simon-Barron Paladin type pellet mill.

The process of the preferred embodiment of my invention comprises the following steps:

1. Grinding or milling peat moss to a particulate composition in a grinder or milling machine respectively, or screening it.

2. Tumbling the particles of peat moss in a rotary tumbler with application of heated air to reduce moisture composition to the order of 30% to 50% by weight. Alternatively, solar drying under correct weather conditions may be employed.

3. Mixing the dried peat moss particles together with coal fines in a mixer unit. The coal fines are customarily found to retain 5% moisture by weight prior to the mixing. The proportion of the coal fines to peat moss is chosen so as to result in a final product that will result in the production of approximately nine thousand BTU per pound of combusted mixture of the end product. Other ratios of coal fines to peat moss may be chosen to provide the desired combustion characteristics of the final product. The coal fines may be a waste product of a coal production facility or may be produced in a hammer mill by grinding anthracite or soft (bituminous) coal.

4. Pelletize the mixture in a pellet mill which extrudes the finished pellets to size. A Simon-Barron Paladin type pellet mill is suitable for the operation of this step of the process.

5. Air dry the resulting pellets by application of heated air, preferably in a tumbler apparatus, to provide a finished moisture content in the range of ten to fifteen percent by weight, or less.

The mixture of coal fines to peat is preferably in the proportions of 25% to 50% peat to 75% to 50% of anthracite or bituminous coal fines by weight to result in a heat content of 9,000 to 11,000 BTU per pound of finished pellets. The peat serves as both a binder for the coal fines and as a combustible fuel material. The peat is preferably of the grade commercially designated as reeds and sedges grade.

The mixed coal fines and peat particulates may be compressed into the shape of briquettes for use in ovens or as a fuel for outdoor barbecue grills.

Sewage reclamation processes produce a dried slugde that may be pulverized and added to either coal fines or peat particulates or both to produce fuel pellets, with the ground sludge material serving as a combustible binder.

Where desired the pellets produced by our process may be further pulverized on site and blown into a furnace to be burnt in suspension; with the pellets being easily transported to the furnace site.

Having thus described the invention, what is claimed as new and to be secured by Letters Patent is:

1. A process for producing a fuel material which may be readily transported comprising the following steps:

a. Make a particulate composition of a peat binder material of combustible properties, b. Dry the ground binder material to remove excessive moisture, c. Mixt a particulate coal or dry sludge fuel material with the said particulate binder material, d. Pelletize this mixture in a pelletizer type machine so as to produce pellets, e. Dry the pellets to further reduce the moisture content of the pellets.

2. The process as recited in claim 1, in which the peat includes peat of the reeds and sedges grade.

3. The process as recited in claim 1 in which coal fines are employed as the particulate fuel material in step c.

4. The process of claim 1 in which dried sludge, in particulate form is employed in addition to coal as the particulate fuel material in step c.

5. The process as recited in claim 1, in which the peat includes peat of the sphagnum moss grade.

6. The process as recited in claim 1 in which the peat includes peat of the humus peat grade.

7. The process as recited in claim 3, in which the binder material is dried to yield a moisture content of not substantially greater than 50% by weight in step b.

8. The process as recited in claim 7 in which the moisture of the finished pellets is in a range of substantially 10% to 15% by weight, after step e.

9. The process of claim 1, in which the particulate composition of the binder material is achieved by a grinding operation.

10. The process of claim 1 in which the particulate composition of the binder material is achieved by a milling operation.

* * * * *